US008285128B2

(12) United States Patent
Berger et al.

(10) Patent No.: US 8,285,128 B2
(45) Date of Patent: Oct. 9, 2012

(54) STEAM GENERATOR FOR A HOUSEHOLD APPLIANCE, HEATABLE USING A HEAT ACCUMULATOR

(75) Inventors: Uwe Berger, Kirchlengern (DE); Hartmut Dittrich, Buende (DE); Thomas Metz, Buende (DE); Joerg Vollgraf, Buende (DE)

(73) Assignee: Miele & Cie. KG, Guetersloh (DE)

( * ) Notice: Subject to any disclaimer, the term of this patent is extended or adjusted under 35 U.S.C. 154(b) by 569 days.

(21) Appl. No.: 12/594,301

(22) PCT Filed: Apr. 10, 2008

(86) PCT No.: PCT/EP2008/002821

§ 371 (c)(1), (2), (4) Date: Oct. 1, 2009

(87) PCT Pub. No.: WO2008/125268

PCT Pub. Date: Oct. 23, 2008

(65) Prior Publication Data

US 2010/0080540 A1 Apr. 1, 2010

(30) Foreign Application Priority Data

Apr. 13, 2007 (DE) ..... 10 2007 017 932

(51) Int. Cl.
*A61H 33/06* (2006.01)
*F22B 37/22* (2006.01)

(52) U.S. Cl. ..... 392/394; 122/35

(58) Field of Classification Search ..... 392/387–406; 122/4 A, 35

See application file for complete search history.

(56) References Cited

U.S. PATENT DOCUMENTS 3,107,975 A * 10/1963 Linder ..... 422/115

(Continued)

FOREIGN PATENT DOCUMENTS

DE 2514771 B1 9/1976

(Continued)

OTHER PUBLICATIONS

European Patent Office, International Search Report in International Patent Application No. PCT/EP2008/002821 (Nov. 4, 2011).

*Primary Examiner* — Daniel L Robinson

(74) *Attorney, Agent, or Firm* — Leydig, Voit & Mayer, Ltd.

(57) ABSTRACT

A steam generator for a household appliance. The steam generator includes an evaporation chamber having a substantially planar evaporation surface with first and second sections. A water supply line is in fluid communication with the evaporation chamber and a steam discharge line is also in fluid communication with the evaporation chamber. The steam generator includes a heat accumulator configured to heat the evaporation surface. At least one of a valve and a pump is associated with the water supply line and operable to control an introduction of water into the evaporation chamber. An electric controller controls the heating of the heat accumulator by the heater and the introduction of water into the evaporation chamber using the at least one of valve and pump. The first section of the evaporation surface is a starter section that is thermally conductively coupled to the heat accumulator such that heat flow from the heat accumulator to the starter section is limited compared to the second section.

18 Claims, 4 Drawing Sheets

U.S. PATENT DOCUMENTS

| | | | | |
|---|---|---|---|---|
| 3,906,188 | A * | 9/1975 | Gamell | 392/391 |
| 4,033,130 | A * | 7/1977 | Hermans | 60/523 |
| 4,071,079 | A * | 1/1978 | Engelbrecht | 165/48.1 |
| 7,112,770 | B2 * | 9/2006 | Doh et al. | 219/682 |
| 2003/0231876 | A1 * | 12/2003 | Millan | 392/390 |
| 2004/0057707 | A1 * | 3/2004 | Lamb | 392/394 |
| 2006/0108433 | A1 | 5/2006 | Fossati et al. | |
| 2009/0151427 | A1 * | 6/2009 | Thompson et al. | 73/23.41 |
| 2010/0080540 | A1 * | 4/2010 | Berger et al. | 392/394 |
| 2010/0154395 | A1 * | 6/2010 | Frick | 60/320 |

FOREIGN PATENT DOCUMENTS

| | | | |
|---|---|---|---|
| DE | 4309240 | A1 | 9/1994 |
| DE | 290603713 | U1 | 8/1996 |
| DE | 19607658 | A1 | 9/1997 |
| DE | 19738415 | A1 | 3/1999 |
| DE | 20317935 | U1 | 2/2004 |
| EP | 1658798 | A1 | 5/2006 |

* cited by examiner

STEAM GENERATOR FOR A HOUSEHOLD APPLIANCE, HEATABLE USING A HEAT ACCUMULATOR

CROSS REFERENCE TO RELATED APPLICATIONS

This is a U.S. National Phase application under 35 U.S.C. §371 of International Application No. PCT/EP2008/002821, filed on Apr. 10, 2008, and claims the benefit of German Patent Application No. 10 2007 017 932.6, filed on Apr. 13, 2007, both incorporated by reference herein. The International Application was published in German on Oct. 23, 2008 as WO 2008/125268 A2 under PCT Article 221(2).

FIELD

The present invention relates to a steam generator for a household appliance that is heatable by a heat accumulator.

BACKGROUND

German Patent DE 25 14 771 C2 describes a heat generator for a household appliance. The steam generator includes an evaporation chamber having fluidically connected thereto a supply line for water and a discharge line for steam, and further includes an evaporation surface that can be heated by a heat accumulator. The steam generator further includes an electric controller which controls or regulates the heating of the heat accumulator by a heater, and the introduction of water by means of a valve located in the supply pipe or a pump. The evaporation surface is provided by the cylindrical circumferential surface of a bore formed in the heat accumulator, said bore forming the evaporation chamber. In this design, a high temperature difference between the temperature of the evaporation surface of the heat accumulator and that of the water to be evaporated leads to what is known as "film boiling" on the hot surface. The resulting steam cushion acts as thermal insulation and prevents effective evaporation.

German Utility Model DE 296 03 713 U1 describes a steam generator having a rotationally symmetric heat accumulator disposed in an evaporation chamber. The evaporation surface is provided by the outer circumferential surface of the heat accumulator. The geometry of the heat accumulator is such that film boiling occurs in one section of the evaporation surface because of the heat transfer conditions occurring therein and that, due to the insulating effect of the steam cushion, heat is conducted in a defined manner to the region of the evaporation surface where nucleate boiling is to be accomplished along with good heat transfer and effective evaporation. In order to achieve this goal, the evaporation surface of the heat accumulator has evaporation ribs formed around its outer surface, the heat flow from the heating element to the evaporation ribs being limited by means provided in the region of the roots of said ribs. In this design, the complex geometric configuration of the heat accumulator is disadvantageous in terms of production costs and the effort required for maintenance, for example, for removal of lime deposits from the evaporation surface.

The heat accumulators described in the aforementioned references have comparatively large masses to obtain a slow and therefore stable steam generator.

As a general principle, it holds that the greater the temperature difference between the accumulator, and thus the evaporation surface, and the water being evaporated, the larger the quantity of water that can be evaporated. The heat transfer rate, and thus the steam generator output, increases. When the temperature difference between the heat accumulator, and thus the evaporation surface, and the water being evaporated is increased above a critical value, the heat transfer rate decreases, goes through a minimum, and then increases again. This is due to the transition from nucleate boiling to film boiling.

EP 1 658 798 A1 describes a thick film heater that uses an approach which explicitly avoids increasing the temperature difference above the critical value, and thus above a critical heat transfer rate.

SUMMARY

In view of the above, an aspect of the present invention is to provide a steam generator for a household appliance, which steam generator can be heated by a heat accumulator having a comparatively smaller heat storage mass and has an easy-to-maintain evaporation surface, and which provides effective evaporation on the evaporation surface and can be used in a wide temperature range. Another, alternative aspect is increased steam generator output even with a low power input for the heater of the heat accumulator.

In an embodiment, the present invention provides steam generator for a household appliance. The steam generator includes an evaporation chamber having a substantially planar evaporation surface with first and second sections. A water supply line is in fluid communication with the evaporation chamber and a steam discharge line is also in fluid communication with the evaporation chamber. The steam generator includes a heat accumulator configured to heat the evaporation surface. At least one of a valve and a pump is associated with the water supply line and operable to control an introduction of water into the evaporation chamber. An electric controller controls the heating of the heat accumulator by the heater and an introduction of water into the evaporation chamber using the at least one of a valve and a pump. The first section of the evaporation surface is a starter section that is thermally conductively coupled to the heat accumulator such that heat flow from the heat accumulator to the starter section is limited compared to the second section.

BRIEF DESCRIPTION OF THE DRAWINGS

An exemplary embodiment of the present invention is shown in the drawings in a purely schematic way and will be described in more detail below. In the drawing.

DETAILED DESCRIPTION

Figure 1:
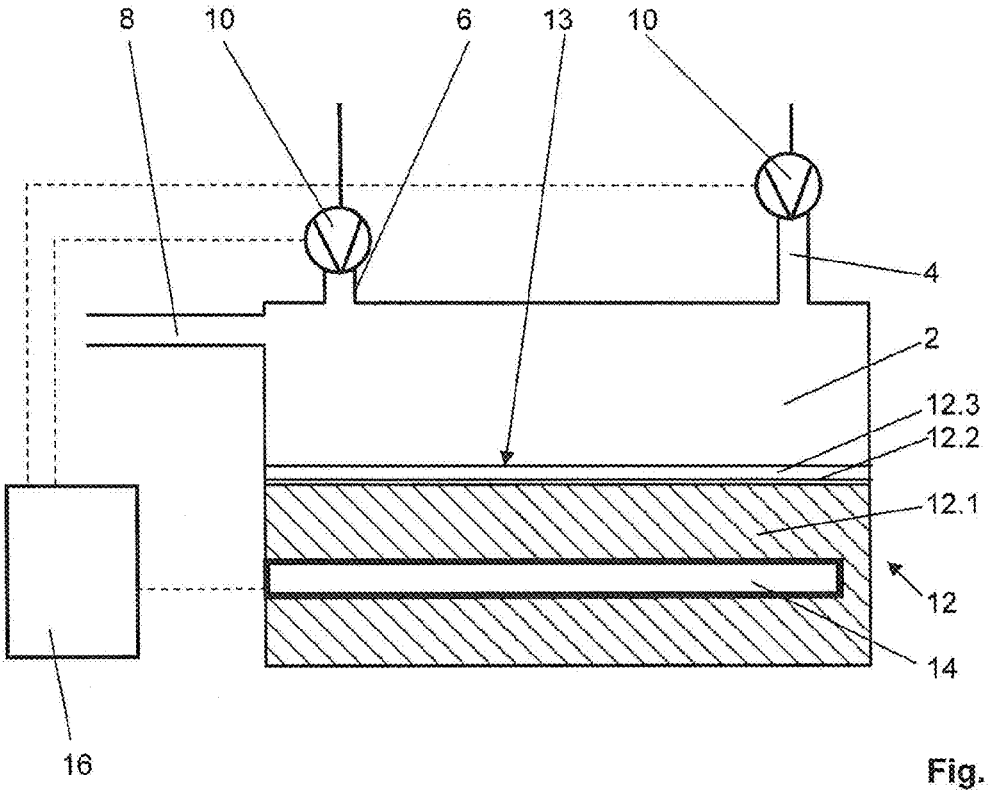
FIG. 1 is a vertical sectional view of an embodiment of a steam generator according to the present invention.

One aspect of the embodiments of the present invention is the substantially horizontal evaporation surface, at least one section of which includes, in its plane, at least one starter section that is thermally conductively coupled to the heat accumulator in such a way that the heat flow from the heat accumulator to the starter section is limited compared to the heat flow to the remaining section of said plane. In this manner, the evaporation output is increased while limiting the power input for the heater of the heat accumulator. In addition, due to the design of its heat accumulator, the steam generator can be used in a wide range of temperatures. The steam generator has the feature that it always provides a high output independently of the accumulator temperature, and that it can be continuously de-accumulated until a temperature of 100° C. is reached.

Alternatively, a desirable faster heating of a steam consumer could be achieved by means of a high power input for the heater of the heat accumulator. However, in many countries, the input power is limited to a relatively low value, so that a theoretically possible further reduction in heat-up time cannot be implemented in known household appliances, such as steam cookers or the like. Therefore, it is useful to use a heat accumulator so as to store thermal energy prior to a subsequent cooking process or the like. Then, during the actual cooking process, it is possible to use thermal energy from the heat accumulator and energy from the electrical supply system, either in combination or separately as desired.

In order to get through the initial film-boiling regime as quickly as possible, the evaporation surface is provided with a starter section that is thermally conductively coupled to the heat accumulator in such a way that when the temperature of the heat accumulator is in a range of from about 250° C. to about 600° C., the heat flow from the heat accumulator to the starter section is no greater than 150 $kW/m^2$. In this manner, it is achieved that the amount of thermal energy flowing into the starter section of the evaporation surface (i.e., into a portion of the evaporation surface) is less than that which, according to the above-described heat transfer performance, is delivered from the starter section to the water to be evaporated. As a result, the starter section of the evaporation surface cools, and the temperature difference between the starter section and the water being evaporated decreases. The evaporation in the region of the starter section re-enters the nucleate-boiling regime, and thus, the range of increased heat transfer performance. In contrast to the starter section, the remaining evaporation surface is much better connected to the heat accumulator in terms of heat transfer, which makes it possible to achieve high evaporation output.

Due to the cooling of the starter section, the adjacent sections of the evaporation surface are also cooled, so that, here too, evaporation changes from the film-boiling regime to the nucleate-boiling regime, in which the heat transfer rate is higher. This process continues in this manner across the entire evaporation surface. Thus, one can say that the starter section acts as a type of a nucleus, triggering a chain reaction that propagates across the entire evaporation surface.

The heat transfer from the heat accumulator to the starter section can, in principle, be selected within wide suitable limits in terms of type and scope. In an advantageous embodiment, the heat flow from the heat accumulator to the starter section is limited by the design of the heat transfer area needed for heat transfer to the starter section and/or by the distance of the starter section from the heat accumulator. Thus, the required limitation of the heat transfer to the starter section is accomplished in a particularly simple way.

In another embodiment, the heat flow from the heat accumulator to the starter section is limited in the region of the starter section by the thermal conductivity of a supporting body in which the evaporation surface is integrated. In this manner, the same geometry can be used for different types of steam generators according to the present invention. According to an embodiment of the present invention, it is also conceivable for the heat transfer from the heat accumulator to the starter section to be controlled by both the geometry of the steam generator and the thermal conductivity of the supporting body.

The temperature of the heat accumulator can, in principle, be selected within wide suitable limits. The higher the temperature of the heat accumulator, the lower may be the mass of the heat accumulator to store the same amount of thermal energy. This allows the energy transferred by the heater into the heat accumulator to be used more efficiently for evaporating the water. However, for example, for reasons of material, or because of low power input of the heater, it may not be possible to increase the temperature of the heat accumulator to any desired level. Because of this, the control of the heater is designed such that the temperature of the heat accumulator is limited to a maximum of about 500° C.

The supply of fresh water into the steam generator can also be selected within wide suitable limits. Accordingly, the supply line may be arranged relative to the evaporation surface in such a way that the water is fed onto the evaporation surface in the region of the starter section. This further reduces the time required to get through the initial film-boiling regime in the starter section of the evaporation surface. In addition, feeding the water always onto the same location on the evaporation surface helps prevent damage to the material because less stress changes will occur. The fresh water can be fed onto the evaporation surface either continuously or discontinuously. In an embodiment, the water is fed continuously onto the evaporation surface.

In accordance with an embodiment, an auxiliary heater is provided to directly heat the supporting body, in particular in the region of the starter section. Thus, after a first operating phase of the steam generator, during which, in accordance with the above-described procedure, the heat accumulator is heated rapidly and a large amount of thermal energy is stored for the generation of steam, the evaporation surface can then be heated directly in a second operating phase, during which the heat accumulator is to be emptied of energy to the greatest extent possible. This improves the energy efficiency. In addition, arranging the auxiliary heater in the region of the starter section enables the starter section, which is poorly thermally coupled to the heat accumulator, to generate a larger amount of steam during this second operation phase. Moreover, the direct heating of the supporting body, and thus of the evaporation surface, allows rapid generation of steam because there is no need for the heat accumulator to be previously charged.

In another embodiment, the supply line is disposed at the end of the evaporation chamber that is opposite the discharge line, and an additional supply line for water is disposed at the end of the evaporation chamber that faces the discharge line. In this manner, a steam generator suitable for generating both saturated steam and overheated steam is implemented with particularly simple means. Depending on whether it is desired to have saturated steam, overheated steam, or steam having a mixed temperature therebetween, the water can be introduced into the steam generator either through the supply line used to generate overheated steam and/or through the additional supply line used to generate saturated steam.

In another embodiment, the discharge line is fluidically connected to a branch line extending through the heat accumulator, and a flow control device is disposed in the discharge line or in the branch line. Thus, alternatively or in addition to the above-described embodiment, it is possible to generate saturated steam, overheated steam, or steam having a mixed temperature therebetween.

In another embodiment, the branch line extends within the heat accumulator in a meandering pattern. The overheating of the steam conveyed in the branch line is thereby accomplished in a particularly simple and effective manner.

The steam generator can, in principle, be selected within wide suitable limits in terms of type, material, geometry and dimensions. In one embodiment, at least two evaporation chambers having separate supply and discharge lines are in heat transfer communication with the heat accumulator. This reduces the structural complexity of a steam generator designed to supply steam to a plurality of consumers.

FIG. 1 shows a first exemplary embodiment of a steam generator for a steam cooking appliance according to the present invention. The steam generator includes an evaporation chamber 2 having fluidically connected thereto a supply line 4 for water, an additional supply line 6 for water, and a discharge line 8 for the generated steam. Pumps 10 are disposed in the supply lines 4 and 6 to pump water from a reservoir of the steam cooking appliance, or from the water supply system, into evaporation chamber 2. Evaporation chamber 2 is bounded on one side by a heat accumulator 12 that can be heated by an electrical heater 14. Electrical heater 14 is removably mounted in heat accumulator 12 in the manner of a cartridge heater, so that intimate thermal contact is achieved between heater 14 and heat accumulator 12. Heat accumulator 12 is composed of a core of cast iron 12.1, a thermal insulation layer made of a heat-resistant plastic material 12.2, and a cover layer of stainless steel 12.3. The surface of cover layer 12.3 facing evaporation chamber 2 also forms an evaporation surface 13.

Alternatively, other suitable materials known to those skilled in the art can be used in place of those described above. For example, other materials having a high specific heat capacity and good thermal conductivity could also be used for core 12.1. The multi-layer design selected for heat accumulator 12 allows it to be manufactured at a lower cost as compared, for example, with a heat accumulator made of stainless steel. In the case of cooking appliances, it is advantageous to use stainless steel for cover layer 12.3 for reasons of hygiene. Thermal insulation layer 12.2 is needed here because stainless steel and cast iron have different thermal expansion coefficients.

In order for the steam generator to be used in a cooking appliance, as proposed here, it can be disposed outside the treatment chamber, i.e., outside the cooking chamber, because a steam generator located in the cooking chamber may affect the cooking result in an undesired manner. The steam generator of the present embodiment operates under atmospheric conditions; i.e., it is not a pressure steam cooker.

Pumps 10 in supply lines 4 and 6, as well as heater 14, are connected in signal communication with an electric controller 16 of the steam cooking appliance in a manner known to those skilled in the art (symbolized here by dotted lines) so as to enable control of the speed and heat output, respectively. Instead of using two pumps 10, it would also be possible to use only one pump in combination with a suitable arrangement of supply lines 4 and 6, or in combination with valves.

In the present embodiment, supply line 4 is disposed at the end of evaporation chamber 2 that is opposite the discharge line 8, and the additional supply line 6 for water is disposed at the end of evaporation chamber 2 that faces the discharge line 8. In this manner, saturated steam, overheated steam, or steam having a mixed temperature therebetween, can be controlled or regulated through the supply of water via supply lines 4 and 6. For example, when all of the water is supplied to evaporation chamber 2 through supply line 4, then overheated steam is generated because the steam is in contact with evaporation surface 12.3 over a long distance until it exits evaporation chamber 2 through discharge line 8. The temperature of the overheated steam so generated is substantially equal to that of evaporation surface 13 in the steady state; i.e., here about 230° C. When the water is introduced into evaporation chamber 2 through further supply line 6, then saturated steam is produced. Under the atmospheric conditions present here, i.e., at normal pressure, the temperature of the saturated steam is 100° C. Mixed temperatures can correspondingly be obtained by introducing the water through both supply lines 4 and 6.

Figure 2:
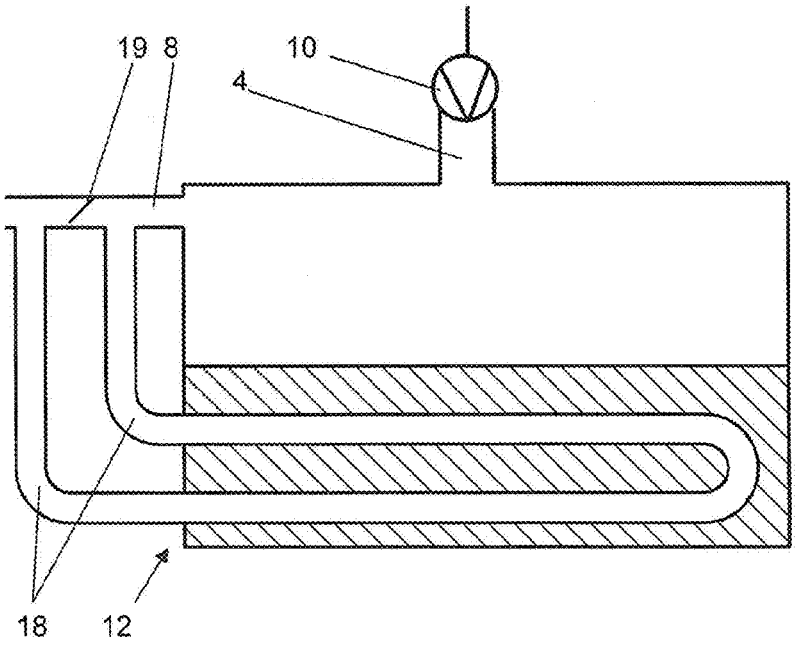
FIG. 2 is a vertical sectional view of another embodiment of a steam generator according to the present invention.

Another embodiment is shown in FIG. 2. This embodiment of a steam generator according to the present invention is also designed to generate saturated steam, overheated steam, or steam having a mixed temperature therebetween. In contrast to the above-described embodiment, only one supply line 4 is needed here. The arrangement of supply line 4 in evaporation chamber 2 and the design of evaporation chamber 2 are such that, initially, saturated steam is generated. As in the first exemplary embodiment, the saturated steam is then conveyed to the consumer; i.e., the cooking chamber of the steam cooking appliance, by way of discharge line 8. In order to generate overheated steam, discharge line 8 is fluidically connected to a branch line 18 extending through heat accumulator 12. The temperature of the steam overheated in this way is substantially equal to that of heat accumulator, here about 400° C. Here, a flow control device 19 in the form of a butterfly valve is disposed in discharge line 8 to control whether saturated steam, overheated steam, or steam having a mixed temperature therebetween, will be introduced into the cooking chamber. Alternatively, flow control device 19 may also be disposed in branch line 18. Flow control device 19 is also connected in signal communication with controller 16.

Figure 3:
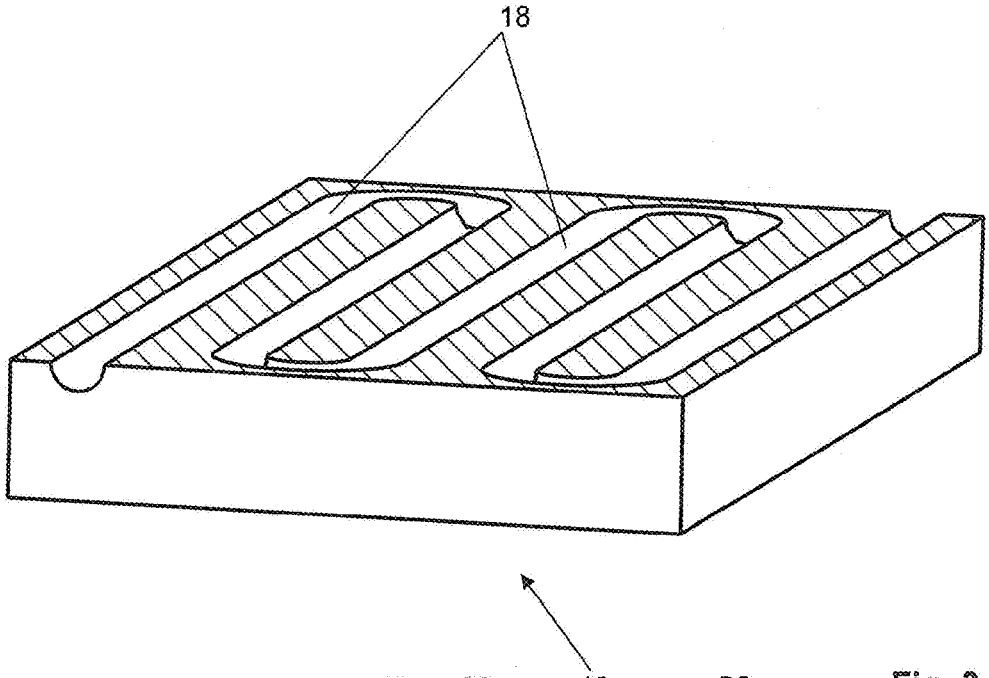
FIG. 3 is a view of a detail of the steam generator of FIG. 2, shown partially cross-sectioned in a horizontal plane.

In order to overheat the steam as efficiently as possible, branch line 18 extends within heat accumulator 12 in a meandering pattern, as shown in FIG. 3.

Figure 4:
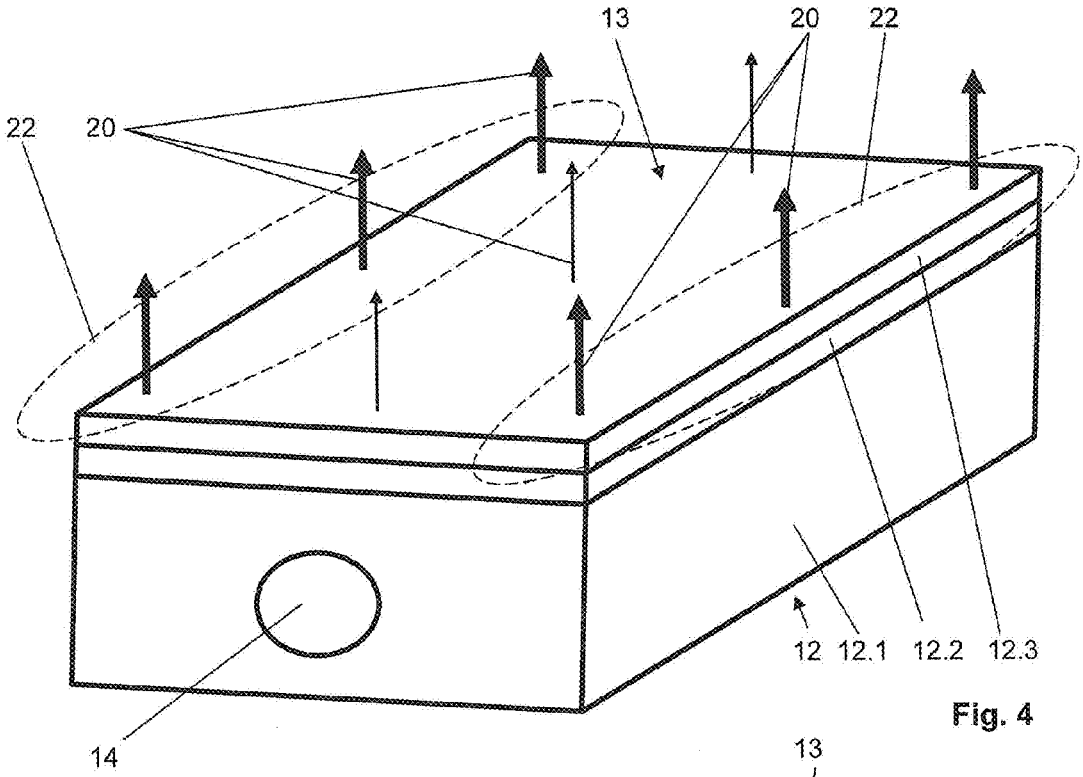
FIG. 4 is a perspective detail view of the steam generator of FIG. 1, showing the region of the heat accumulator including the evaporation surface.

In FIG. 4, heat accumulator 12, including the integrated evaporation surface 13, and heater 14 of the embodiment of FIG. 1 are shown in a perspective view. The walls of evaporation chamber 2 are not shown in FIGS. 4 through 7 for clarity of representation. Heater 14 extends in heat accumulator 12 from front left to rear right in the plane of the drawing. The ratio of the thermal energy transferred from heat accumulator 12, here core 12.1, to evaporation surface 13 to the thermal energy withdrawn from evaporation surface 13 by evaporation of the water is symbolized by arrows 20. The narrow arrows 20 in the middle of evaporation surface 13 indicate that the amount of thermal energy supplied to this region of evaporation surface 13 is greater than that withdrawn therefrom by evaporation of the water. The opposite is true for the broad arrows 20 in the periphery of evaporation surface 13. This is because heater 14 is located in the middle of core 12.1 of heat accumulator 12 and because, therefore, the heater is better thermally coupled to the middle region of evaporation surface 13. Here, both peripheral regions of evaporation surface 13 serve as starter sections 22, which is symbolized by dashed lines. In this connection, it will be understood that starter sections 22 are regions of evaporation surface 13 which are not clearly demarcated from the rest of evaporation surface 13. Thus, in this embodiment of heat accumulator 12, the required heat transfer is obtained in particular by means of the distance of starter sections 22 from core 12.1 of heat accumulator 12.

The two supply lines 4 and 6 are disposed on evaporation chamber 2 in such a way that the water is fed onto evaporation surface 13 in the region of starter sections 22; i.e., here in the two peripheral regions of evaporation surface 13. To this end, supply lines 4 and 6 bifurcate prior to entering evaporation chamber 2. The supply of water is controlled or regulated by controller 16 in such a way that the amount of water introduced into evaporation chamber 2 is just equal to the amount currently needed in the form of steam by the consumer, in this case the cooking chamber of the steam cooking appliance.

In an embodiment, the control of heater 14 is designed such that the temperature of the heat accumulator is limited to a maximum of about 400° C. here.

With regard to the heat transfer from core 12.1 to evaporation surface 13, the geometry of heat accumulator 12 is matched to the maximum temperature of the heat accumulator in such a way that the heat flow from core 12.1 of heat accumulator 12 to starter sections 22 of evaporation surface 13 is no greater than 150 $kW/m^2$ in this embodiment.

Figure 5:
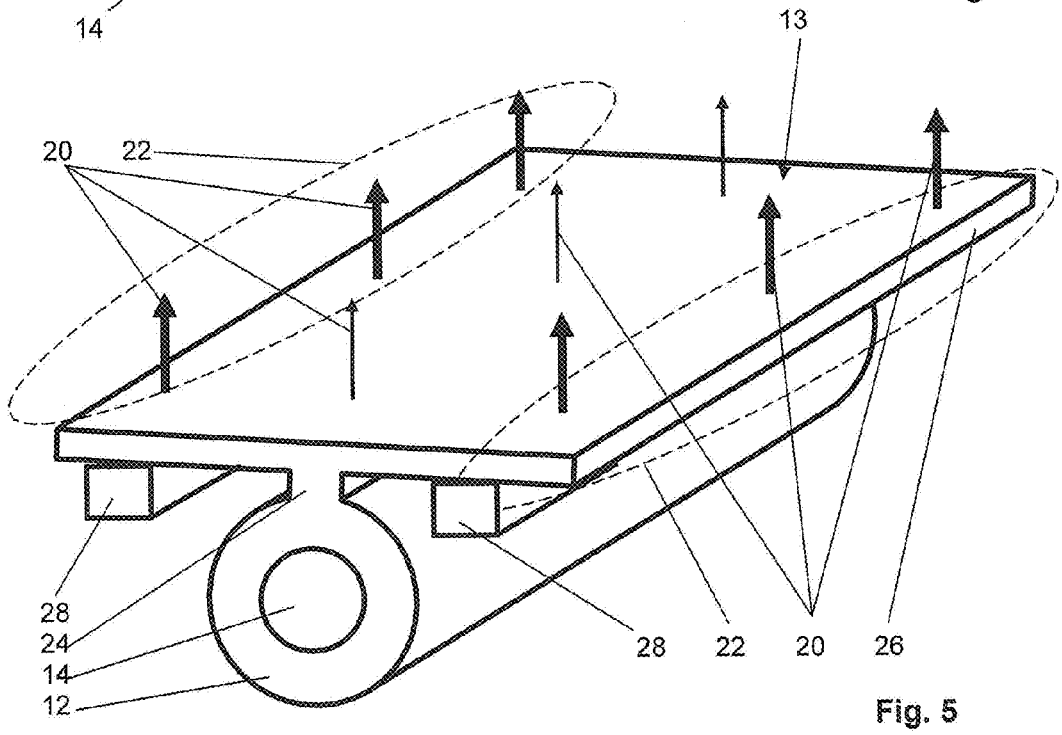

Another embodiment of heat accumulator 12 is shown in FIG. 5. While in the aforementioned embodiment, evaporation surface 13 is integrated into heat accumulator 12, here heat accumulator 12 is thermally conductively coupled to a supporting body 26 via a connecting web 24. Here, heat accumulator 12 is made of cast iron and is thermally conductively coupled to the stainless steel supporting body 25 in a manner known to those skilled in the art via the connecting web 24 made of copper. The surface of supporting body 26 forms the evaporation surface 13 here. The above explanations regarding the embodiment of FIG. 4 of heat accumulator 12 apply analogously. Here too, the required limitation of the heat transfer from heat accumulator 12 to starter sections 22 is provided by the distance of the peripheral regions of evaporation surface 13 which, similarly to the first exemplary embodiment, form the starter sections 22. However, here, because the heat flows via narrow web 24, the distance of starter sections 22 from heat accumulator 12 is greater than in the first exemplary embodiment. There is correspondingly less heat transfer between heat accumulator 12 and starter sections 22. Therefore, here the temperatures of the heat accumulator can be higher than in the first exemplary embodiment and/or the water to be evaporated can be fed onto the entire evaporation surface 13.

In this embodiment, two auxiliary heaters 28 are attached to supporting body 26 in a manner known to those skilled in the art, each in the region of a starter section 22. Auxiliary heaters 28 are elongated in shape and are used to directly heat evaporation surface 13, in particular to directly heat starter sections 22. Similarly to heater 14, auxiliary heaters 28 are connected in signal communication with controller 16.

Figure 6:
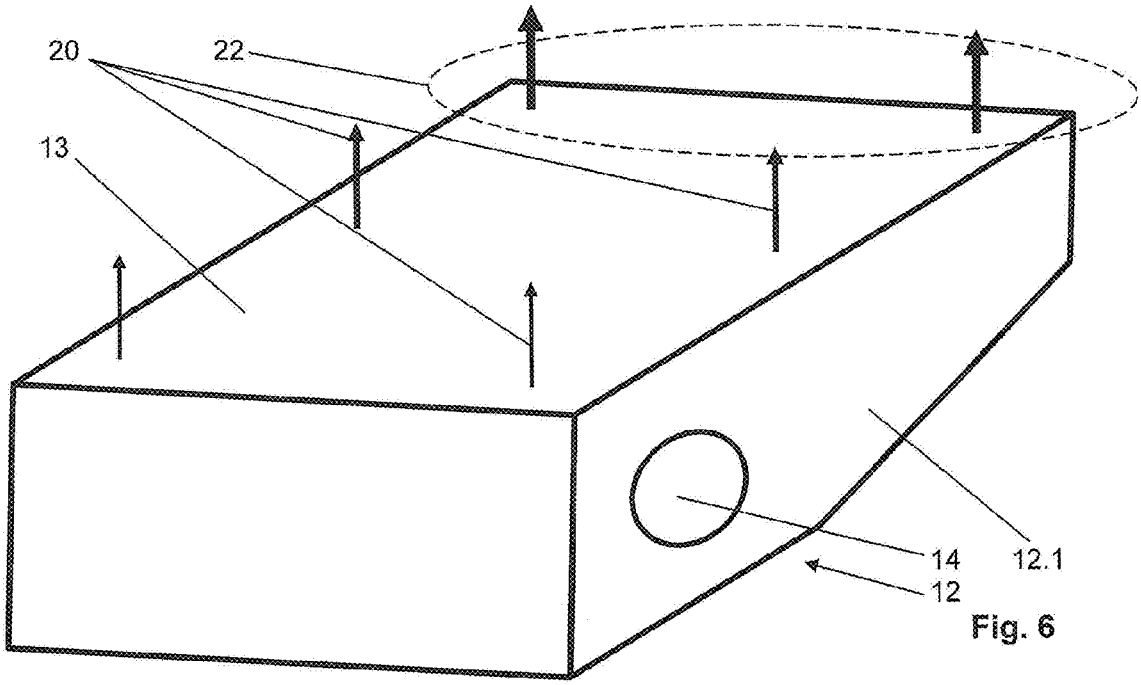

FIG. 6 shows another embodiment of heat accumulator 12. Here, heater 14 extends in heat accumulator 12 from left to right in the plane of the drawing. In contrast to the aforementioned embodiments of heat accumulator 12, there is only one starter section 22 here. Here too, the limitation of the heat transfer from core 12.1 of heat accumulator 12 to starter section 22 is provided by the distance of the peripheral region of evaporation surface 13. However, here core 12.1 of heat accumulator 12 is directly adjacent to evaporation surface 13. Here, no thermal insulation layer 12.2 or cover layer 12.3 is used. This is also possible in the case of a cooking appliance, provided a suitable material is selected, for example stainless steel. Here, in addition to the distance of starter section 22 from core 12.1, the heat transfer area is configured to taper toward starter section 22, which results in a further reduction in heat transfer to starter section 22.

Figure 7:
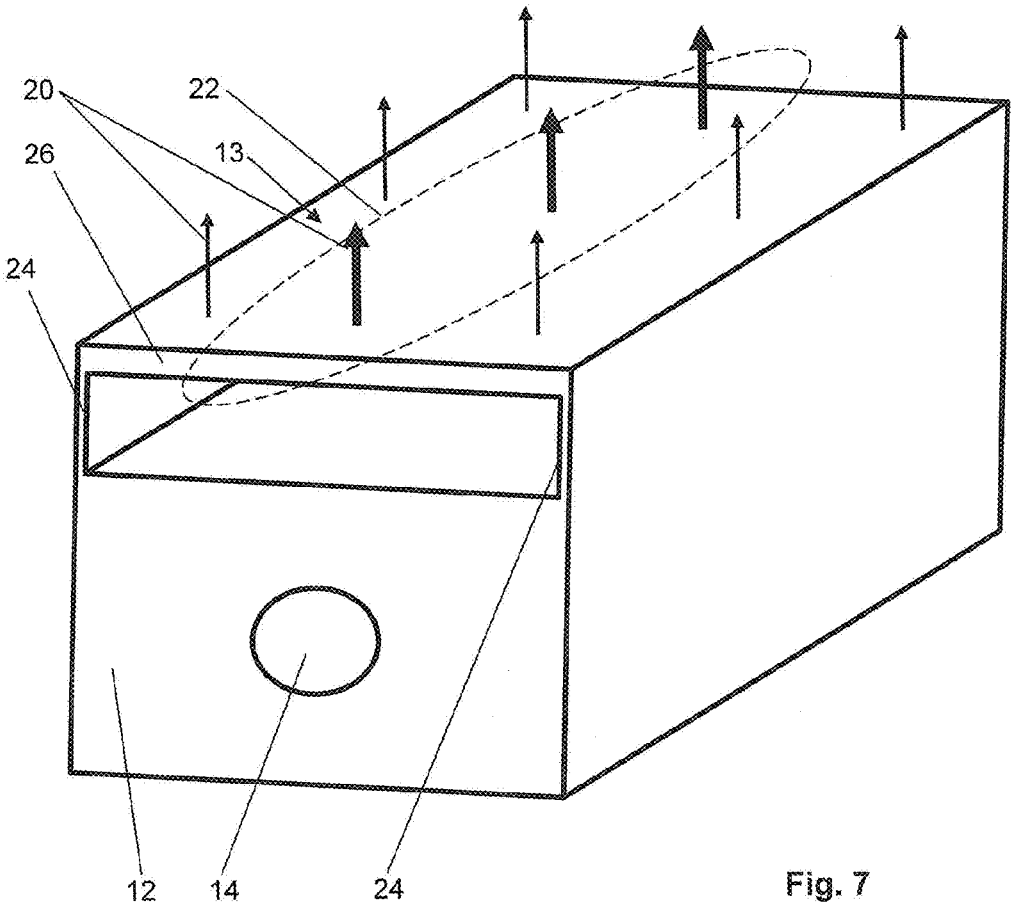

Another embodiment of heat accumulator 12 is shown in FIG. 7. Here, the arrangement of heater 14 within heat accumulator 12 is similar to the exemplary embodiments shown in FIGS. 4 and 5. Here, similar to the embodiment of FIG. 5, heat accumulator 12 is thermally conductively connected to supporting body 26 via connecting webs 24, the evaporation surface 13 again being integrated in supporting body 26. Here, in contrast to the exemplary embodiment of FIG. 5, only one starter section 22 is provided, just as in the last-mentioned exemplary embodiment according to FIG. 6.

Figure 8:
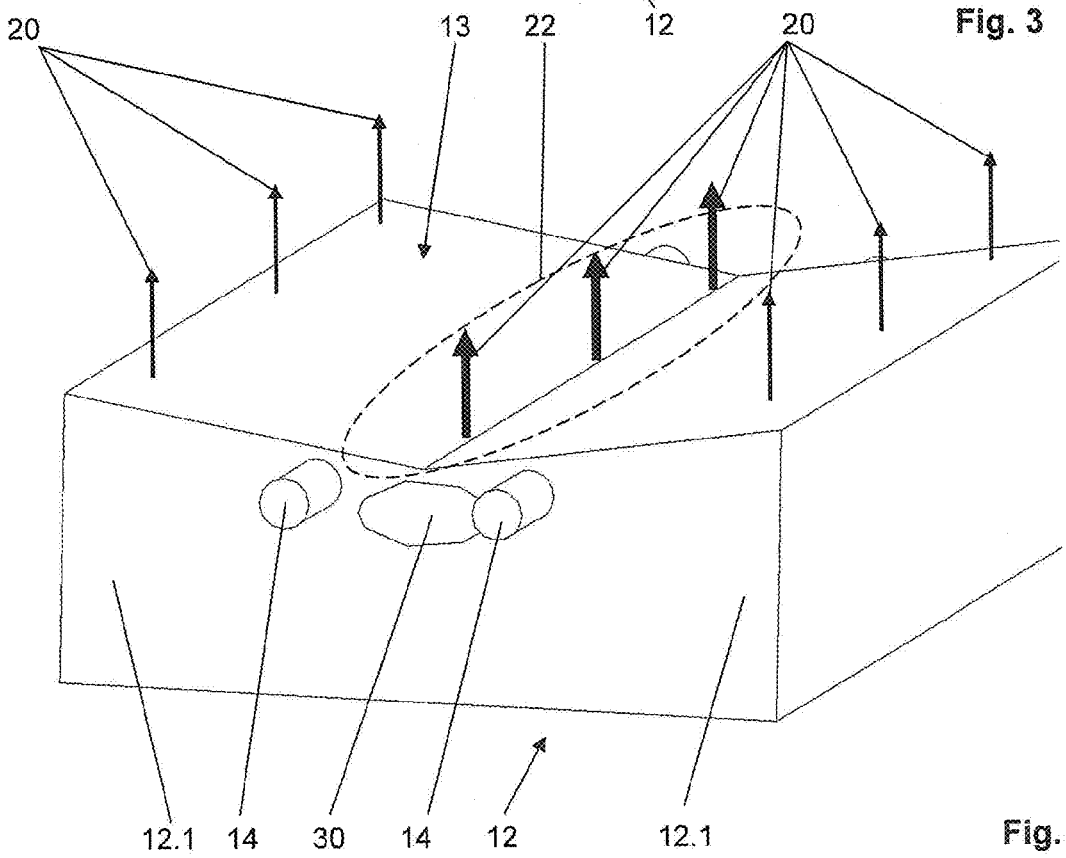
FIGS. 5 through 8 are views similar to that of FIG. 4, showing further embodiments of a heat accumulator and its evaporation surface.

FIG. 8 shows yet another embodiment similar to that of FIG. 6, the difference being that here the geometry of FIG. 6 is provided symmetrically on two sides. In this manner, a heat transfer area is obtained which tapers from the two lateral edges toward the middle of the figure. The starter section 22 of evaporation surface 13 is formed in the middle. Two heaters 14 are arranged in heat accumulator 12 along the sides of a through-hole. Here, two cores 12.1 are provided instead of just one. In this exemplary embodiment, no auxiliary heater is needed to directly heat evaporation surface 13, in particular starter section 22.

The present invention is not limited to the described exemplary embodiments or constructions. For example, the steam generator of the present invention could also be used in other household appliances, such as dishwashers, washing machines, laundry dryers, ironing machines, or the like. In a departure from the examples described herein, in which only one evaporation chamber is combined with a heat accumulator and an evaporation surface, it is also possible to provide at least two evaporation chambers which each have separate supply and discharge lines for water and steam, respectively, and which are in heat transfer communication with the heat accumulator, for example via one or more evaporation surface(s).

What is claimed is:

1. A steam generator for a household appliance, the steam generator comprising:

an evaporation chamber including a substantially planar evaporation surface with first and second sections;

a water supply line in fluid communication with the evaporation chamber;

a steam discharge line in fluid communication with the evaporation chamber;

a heat accumulator configured to heat the evaporation surface;

at least one of a valve and a pump associated with the water supply line and operable to control an introduction of water into the evaporation chamber; and an electric controller operable to control a heating of the heat accumulator with a heater and to control an introduction of water into the evaporation chamber using the at least one of a valve and a pump;

wherein the first section is a starter section that is thermally conductively coupled to the heat accumulator such that heat flow from the heat accumulator to the starter section is limited compared to the second section.

2. The steam generator as recited in claim 1 wherein the heat accumulator is configured such that heat flow from the heat accumulator to the starter section is no greater than 150 $kW/m^2$ when a temperature of the heat accumulator is in a range of from about 250° C. to about 600° C.

3. The steam generator as recited in claim 1 wherein the heat flow from the heat accumulator to the starter section is limited by at least one of a configuration of a heat transfer area between the heat accumulator and the starter section and a distance between the heat accumulator and the starter section.

4. The steam generator as recited in claim 2 wherein the heat flow from the heat accumulator to the starter section is limited by at least one of a configuration of a heat transfer area between the heat accumulator and the starter section and a distance between the heat accumulator and the starter section.

5. The steam generator as recited in claim 1, wherein the evaporation surface is integrated into a supporting body having a thermal conductivity operable to limit the heat flow to the starter section.

6. The steam generator as recited in claim 2, wherein the evaporation surface is integrated into a supporting body having a thermal conductivity operable to limit the heat flow to the starter section.

7. The steam generator as recited in claim 3, wherein the evaporation surface is integrated into a supporting body having a thermal conductivity operable to limit the heat flow to the starter section.

8. The steam generator as recited in claim 1, wherein the controller is configured to control the heater so as to limit a maximum temperature of the heat accumulator to 500° C.

9. The steam generator as recited in claim 2, wherein the controller is configured to control the heater so as to limit a maximum temperature of the heat accumulator to 500° C.

10. The steam generator as recited in claim 3, wherein the controller is configured to control the heater so as to limit a maximum temperature of the heat accumulator to 500° C.

11. The steam generator as recited in claim 5, wherein the controller is configured to control the heater so as to limit a maximum temperature of the heat accumulator to 500° C.

12. The steam generator as recited in claim 1, wherein the water supply line is disposed such that water supplied to the evaporation surface in a vicinity of the starter section.

13. The steam generator as recited in claim 5, further comprising an auxiliary heater disposed so as to heat the supporting body directly.

14. The steam generator as recited in claim 13, wherein the auxiliary heater disposed in a vicinity of the starter section.

15. The steam generator as recited in claim 1, wherein the water supply line is disposed at an end of the evaporation chamber that is opposite the steam discharge line, and further comprising an additional water supply line facing the steam discharge line.

16. The steam generator as recited in claim 1 further comprising:

a branch line extending through the heat accumulator, the branch line being in fluid communication with the steam discharge line; and a flow control device disposed in at least one of the discharge line and the branch line.

17. The steam generator as recited in claim 16, wherein the branch line extends through the heat accumulator in a meandering pattern.

18. The steam generator as recited in claim 1, further comprising a second evaporation chamber include a separate supply line and a separate discharge line, the second evaporation chamber being in heat transfer communication with the heat accumulator.

* * * * *